US008380115B2

(12) United States Patent
Shintani et al.

(10) Patent No.: US 8,380,115 B2
(45) Date of Patent: Feb. 19, 2013

(54) LUBRICANT APPLICATOR, IMAGE FORMING APPARATUS, AND PROCESS CARTRIDGE

(75) Inventors: Takeshi Shintani, Kawasaki (JP); Daisuke Tomita, Yokohama (JP); Satoshi Hatori, Yokohama (JP); Nobuo Kuwabara, Yokohama (JP); Akio Kosuge, Yokohama (JP); Shinichi Kawahara, Tokyo (JP); Yoshinori Ozawa, Atsugi (JP)

(73) Assignee: Ricoh Company, Limited, Tokyo (JP)

( * ) Notice: Subject to any disclaimer, the term of this patent is extended or adjusted under 35 U.S.C. 154(b) by 357 days.

(21) Appl. No.: 12/654,863

(22) Filed: Jan. 7, 2010

(65) Prior Publication Data

US 2010/0183349 A1 Jul. 22, 2010

(30) Foreign Application Priority Data

Jan. 16, 2009 (JP) ..... 2009-007837

(51) Int. Cl.
*G03G 21/00* (2006.01)

(52) U.S. Cl. ..... 399/346

(58) Field of Classification Search ..... 399/31, 399/346

See application file for complete search history.

(56) References Cited

U.S. PATENT DOCUMENTS

| | | | | |
|---|---|---|---|---|
| 7,146,122 | B2 | 12/2006 | Hatori | |
| 7,313,347 | B2 | 12/2007 | Shintani | |
| 7,366,441 | B2 | 4/2008 | Hatori | |
| 7,493,061 | B2 | 2/2009 | Hatori | |
| 7,899,382 | B2 | 3/2011 | Hozumi et al. | |
| 2006/0039717 | A1 | 2/2006 | Hatori | |
| 2006/0039726 | A1 | 2/2006 | Shintani | |
| 2006/0045603 | A1 | 3/2006 | Hatori | |
| 2006/0193655 | A1 | 8/2006 | Hatori | |
| 2007/0122217 | A1* | 5/2007 | Nagashima et al. | 399/346 |
| 2008/0069614 | A1 | 3/2008 | Shintani | |
| 2008/0069615 | A1 | 3/2008 | Shintani | |
| 2009/0010692 | A1* | 1/2009 | Hozumi et al. | 399/346 |
| 2009/0010693 | A1 | 1/2009 | Hatori | |
| 2009/0022504 | A1 | 1/2009 | Kuwabara | |
| 2009/0103944 | A1 | 4/2009 | Shintani | |
| 2009/0142115 | A1 | 6/2009 | Muraishi | |
| 2009/0185842 | A1 | 7/2009 | Hatori | |
| 2009/0241830 | A1 | 10/2009 | Koike | |
| 2009/0252510 | A1 | 10/2009 | Shintani | |

FOREIGN PATENT DOCUMENTS

| | | | |
|---|---|---|---|
| JP | 2001324907 | A | 11/2001 |
| JP | 2002-244485 | | 8/2002 |
| JP | 2002-244486 | | 8/2002 |
| JP | 3733237 | | 10/2005 |
| JP | 2007-140391 | | 6/2007 |
| JP | 2007292996 | A | 11/2007 |
| JP | 2008276125 | A | 11/2008 |

* cited by examiner

*Primary Examiner* — David Gray
*Assistant Examiner* — Andrew Do
(74) *Attorney, Agent, or Firm* — Harness, Dickey & Pierce, P.L.C.

(57) ABSTRACT

A lubricant applicator rotatable at multiple different linear velocities, including a rotatable lubricant applying member to scrape a lubricant and to apply the lubricant to a surface of an image carrier rotatable at multiple different linear velocities. Any given linear velocity of the lubricant applying member satisfies a relation of $n_1/N_1>n_2/N_2> \ldots n_x/N_x$, where $N_1$, $N_2, \ldots N_x$ ($N_1<N_2< \ldots N_x$) are the multiple different linear velocities of the image carrier, and $n_1, n_2, \ldots n_x$ are multiple linear velocities of the lubricant applying member corresponding to the multiple linear velocities of the image carrier.

7 Claims, 3 Drawing Sheets

LUBRICANT APPLICATOR, IMAGE FORMING APPARATUS, AND PROCESS CARTRIDGE

PRIORITY STATEMENT

The present patent application claims priority from Japanese Patent Application No. 2009-007837, filed on Jan. 16, 2009 in the Japan Patent Office, which is hereby incorporated herein by reference in its entirety.

BACKGROUND

1. Technical Field

Illustrative embodiments described in this patent specification generally relate to a lubricant applicator to apply a lubricant to a surface of an image carrier, an image forming apparatus including the lubricant applicator, and a process cartridge detachably attachable to the image forming apparatus.

2. Description of the Related Art

Related-art image forming apparatuses, such as copiers, printers, plotters, facsimile machines, or multifunction devices having two or more of copying, printing, plotting, and facsimile functions, typically form a toner image on a recording medium (e.g., a sheet) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

In recent years, in the market for toner-based image forming apparatuses there is increasing demand for higher-quality images and the ability to handle a wide variety of recording media. In order to provide higher-quality images, toner having a smaller particle diameter and a round particle shape is widely used. Although generally successful, with the use of such toner there is some difficulty in removing residual toner from the surface of the photoconductor after an imaging operation.

To solve the above-described difficulty, one common arrangement involves the use of a brush roller scraping a solid lubricant to apply the lubricant to the surface of the photoconductor in order to reduce a frictional factor of the photoconductor and thereby facilitate residual toner removal.

In addition, various attempts have been made to enhance the capability to handle a wide variety of recording media. For example, relatively heavy recording media sheets require that the fixing device use more heat to melt the toner and fix the toner image to the heavy sheets.

In particular, more heat is required for image forming apparatuses with faster printing speeds, that is, image forming apparatuses having a higher process linear velocity or a higher linear velocity of the image carrier.

However, because the amount of electric power available for operating the image forming apparatuses is limited, when heavy sheets are used the printing speed is generally decreased, that is, the process linear velocity or the linear velocity of the image carrier is decreased. Therefore, the image carrier, more specifically a motor for rotatively operating the image carrier, is generally driven at multiple different linear velocities.

The above-described image forming apparatuses still require constant application of lubricant to the surface of the image carrier to reliably provide a lower frictional factor of the surface of the image carrier, thereby achieving higher image quality.

Accordingly, a variety of techniques for application of lubricant has been proposed. For example, how to control an amount a lubricant to be applied to an image carrier depending on an image area ratio and on deterioration of the image carrier and a brush roller is disclosed in Published Unexamined Japanese Patent Application Nos. 2002-244485 and 2002-244486.

In another approach, Japanese Patent No. 3733237 (hereinafter referred to as JP-3733237-B) discloses a technique in which a lubricant is applied to an image carrier only when the image carrier is rotated at linear velocities that cause chattering marks or squeal of a cleaning blade among multiple linear velocities of the image carrier.

In a case in which the lubricant is applied to the surface of the image carrier rotated at multiple linear velocities by a rotating brush roller, a ratio between a linear velocity of the image carrier and that of the brush roller is generally kept constant in order to apply the same amount of the lubricant to the surface of the image carrier regardless of the linear velocities. However, an impact occurring when the brush roller contacts the solid lubricant is different at each of the multiple linear velocities. Consequently, an amount of the lubricant scraped off by the brush roller differs depending on the linear velocities of the image carrier, and an amount of the lubricant applied to the surface of the image carrier is different at each of the multiple linear velocities. Therefore, the method disclosed in JP-3733237-B does not solve the problem of how to consistently apply the same amount of the lubricant to the image carrier regardless of the linear velocity of the image carrier.

SUMMARY

In view of the foregoing, illustrative embodiments described herein provide an improved lubricant applicator capable of reliably applying a constant amount of a lubricant to an image carrier regardless of a linear velocity of the image carrier to provide higher-quality images and long product life of components. Further illustrative embodiments described herein provide an image forming apparatus including the lubricant applicator and a process cartridge detachably attachable to the image forming apparatus.

At least one embodiment provides a lubricant applicator rotatable at multiple different linear velocities, including a rotatable lubricant applying member to scrape a lubricant and to apply the lubricant to a surface of an image carrier rotatable at multiple different linear velocities. Any given linear velocity of the lubricant applying member satisfies a relation of $n_1/N_1>n_2/N_2>\ldots n_x/N_x$, where $N_1, N_2, \ldots N_x$ ($N_1<N_2<\ldots N_x$) are the multiple different linear velocities of the image carrier, and $n_1, n_2, \ldots n_x$ are multiple linear velocities of the lubricant applying member corresponding to the multiple linear velocities of the image carrier.

At least one embodiment provides an image forming apparatus including an image carrier, rotated to carry an electrostatic latent image on a surface thereof; a transfer member to transfer the toner image onto a recording medium; and the lubricant applicator described above.

At least one embodiment provides a process cartridge detachably attachable to the image forming apparatus described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein.

Figure 1:
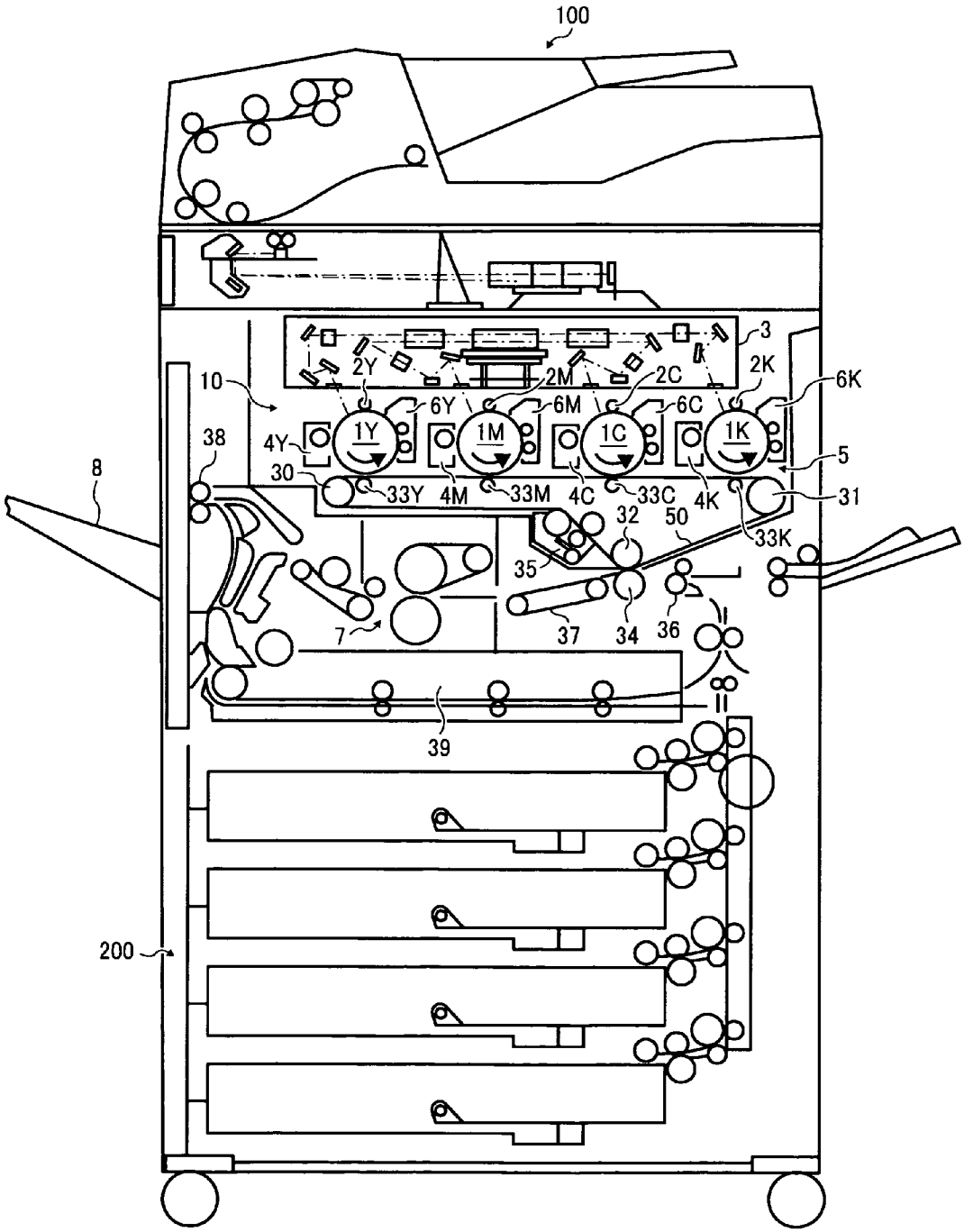
FIG. 1 is a schematic view illustrating a configuration of an image forming apparatus according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

A description is now given of a configuration of an image forming apparatus such as a full-color copier including a process cartridge according to illustrative embodiments with reference to FIG. 1.

An image forming apparatus 100 according to illustrative embodiments includes an image forming unit 10 within which four drum-type photoconductors 1Y, 1M, 1C, and 1K (hereinafter collectively referred to as photoconductors 1) each serving as an image carrier capable of carrying a toner image of a complementary color, that is, yellow, magenta, cyan, or black, are arranged along an extended surface of an intermediate transfer belt 50 serving as a transfer member of a transfer device 5.

Chargers 2Y, 2M, 2C, and 2K (hereinafter collectively referred to as chargers 2), developing devices 4Y, 4M, 4C, and 4K (hereinafter collectively referred to as developing devices 4), and cleaning devices 6Y, 6M, 6C, and 6K (hereinafter collectively referred to as cleaning devices 6) are provided around the photoconductors 1, respectively. An irradiating device 3 serving as a latent image forming device is provided above the photoconductors 1.

The transfer device 5 is provided below the photoconductors 1. The intermediate transfer belt 50 is supported by rollers 30, 31, and 32, and primary transfer rollers 33Y, 33M, 33C, and 33K each serving as primary transfer means are provided respectively corresponding to the photoconductors 1 in an inner circumferential portion of the intermediate transfer belt 50. A secondary transfer roller 34 serving as secondary transfer means is provided opposite the roller 32. The secondary transfer roller 34 transfers a full-color toner image formed on the intermediate transfer belt 50 onto a recording medium such as a sheet at one time.

A description is now given of a sequence of image forming operations using a negative-positive process performed by the image forming apparatus 100 having the above-described configuration.

First, surfaces of the photoconductors 1 are neutralized by neutralizing lamps or the like, not shown, and then are evenly charged to a negative polarity by the chargers 2 each having a charging member to be described later. Subsequently, laser beams LB emitted from the irradiating device 3 such as a laser optical system are directed onto the charged surfaces of the photoconductors 1 to form latent images on the surfaces of the photoconductors 1, respectively. Specifically, each of the laser beams LB is emitted from a semiconductor laser, and scans the charged surfaces of the photoconductors 1 in an axial direction of the photoconductors 1 using a polygon mirror rotated at high speed or the like.

The latent images thus formed are developed by the developing devices 4 with toner or developer, that is, a mixture of toner and carrier, supplied to developing sleeves each serving as a developer carrier of the respective developing devices 4. Accordingly, toner images are formed on the surfaces of the respective photoconductors 1.

The toner images thus formed are sequentially transferred onto the intermediate transfer belt 50 in a superimposed manner by the primary transfer rollers 33, so that a full-color toner image is formed on the intermediate transfer belt 50. The full-color toner image thus formed on the intermediate transfer belt 50 is transferred by the secondary transfer roller 34 onto a sheet fed from a sheet feeder 200.

Specifically, the sheet fed from a selected one of sheet feed cassettes of the sheet feeder 200 is temporarily stopped at a pair of registration rollers 36 to align a position of the sheet. Thereafter, the sheet is conveyed to a secondary transfer position formed between the intermediate transfer belt 50 and the secondary transfer roller 34 at a predetermined timing so that the full-color toner image formed on the intermediate transfer belt 50 is transferred onto the sheet by the secondary transfer roller 34.

The sheet having the transferred full-color toner image thereon is conveyed by the conveyance belt 37 to a fixing device 7. In the fixing device 7, heat and pressure are applied to the sheet to fix the full-color toner image to the sheet. The sheet having a fixed full-color image thereon is then discharged to a discharge tray 8 by a pair of discharge rollers 38. In a case of duplex printing, the sheet having the fixed full-color image thereon is conveyed to a duplex unit 39 from the fixing device 7, and is further conveyed to the pair of the registration rollers 36 again so that the above-described sequence of image forming operations is performed for a back side of the sheet.

Residual toner remaining on the surfaces of the photoconductors 1 after primary transfer is removed and collected by the cleaning devices 6, and residual toner on the intermediate transfer belt 50 after secondary transfer is removed and collected by a belt cleaning device 35.

Although the intermediate transfer belt 50 is used to employ an intermediate transfer system as described above in the image forming apparatus 100, alternatively, a direct transfer system in which toner images formed on the surfaces of the photoconductors 1 are sequentially transferred directly onto the sheet in a superimposed manner while the sheet is conveyed by a conveyance belt may be employed.

Figure 2:
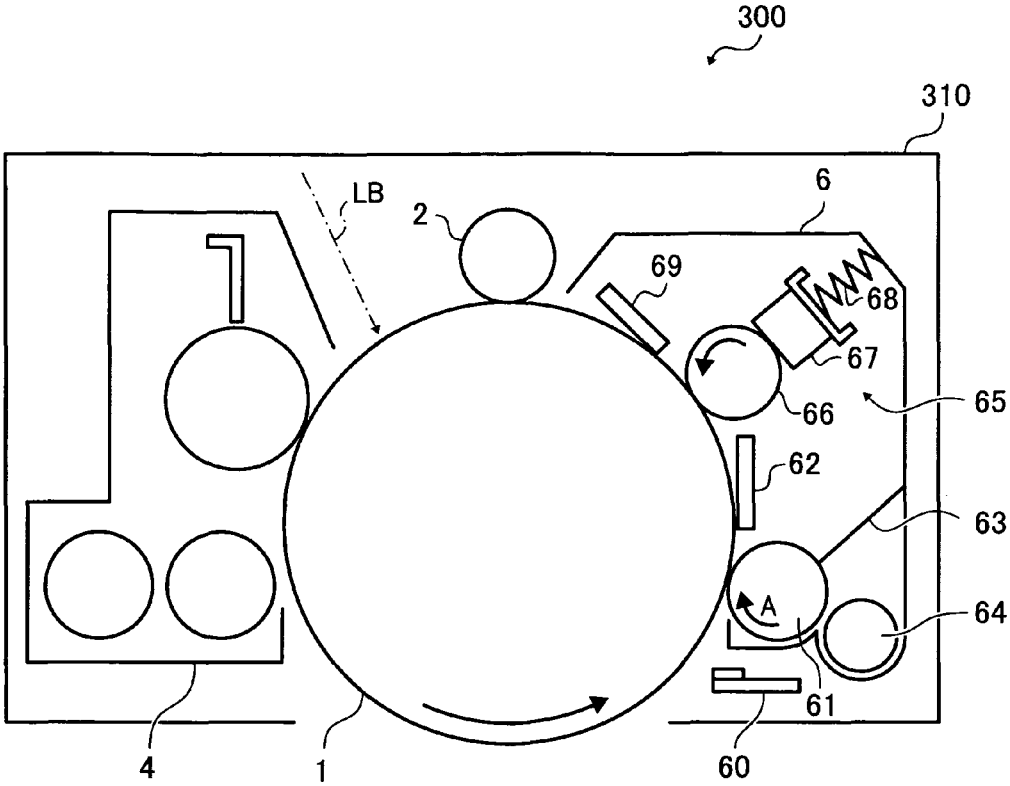
FIG. 2 is a vertical cross-sectional view illustrating a configuration of a process cartridge according to illustrative embodiments.
Figure 3:
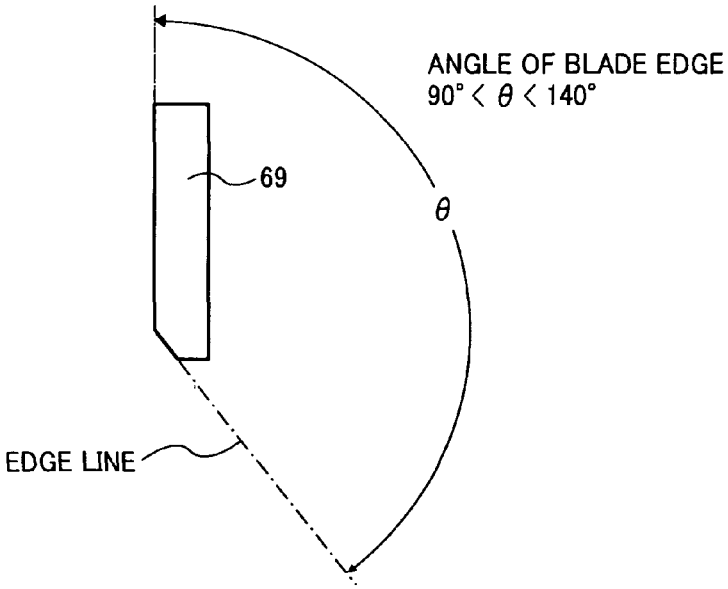
FIG. 3 is a view illustrating an angle of an edge of a cleaning blade contacting a photoconductor of the image forming apparatus of FIG. 1.

A description is now given of a configuration of a process cartridge 300 for a specific color of yellow, magenta, cyan, or black detachably attachable to the image forming apparatus 100 according to illustrative embodiments. FIG. 2 is a vertical cross-sectional view illustrating a configuration of the process cartridge 300.

The process cartridge 300 includes a frame 310, and the photoconductor 1 serving as an image carrier and process means are provided within the frame 310. Specifically, the process means includes the charger 2 serving as charging means, the developing device 4 serving as developing means, and the cleaning device 6 serving as cleaning means.

Although the process cartridge 300 itself can be replaced with a new one according to illustrative embodiments, alternatively, the process cartridge 300 may be detached from the image forming apparatus 100 simply in order to replace the photoconductor 1, the charger 2, the developing device 4, or the cleaning device 6 with a new one.

Image data read by a scanner, not shown, is separated into four different colors of yellow, cyan, magenta, and black, and image data of each color is written on the surface of the corresponding photoconductor 1 evenly charged by the charger 2 to form an electrostatic latent image of each color.

A sequence of image forming operations is performed by the process cartridge 300 having the above-described configuration as follows. The electrostatic latent images formed on the surfaces of the photoconductors 1 are developed by the developing devices 4 with toner of the colors of yellow, magenta, cyan, and black, respectively, to form toner images of the respective colors. The toner images thus formed are sequentially transferred onto the intermediate transfer belt 50 and superimposed one atop the other in order from yellow to cyan, magenta, and black, at portions where the photoconductors 1 and the intermediate transfer belt 50 contact each other, so that a full-color toner image is formed on the intermediate transfer belt 50. A transfer sheet is fed from the pair of the registration rollers 36 to the secondary transfer position in synchronization with the full-color toner image thus formed on the intermediate transfer belt 50 and the full-color toner image is transferred onto the transfer sheet by the secondary transfer roller 34.

Meanwhile, the photoconductors 1 after primary transfer of the toner images onto the intermediate transfer belt 50 are cleaned by the cleaning devices 6 to remove residual toner adhering to the surfaces of the photoconductors 1. Thereafter, the surfaces of the photoconductors 1 are neutralized by the neutralizing lamps, not shown, and are evenly charged by the chargers 2 again. The above-described sequence of image forming operations is repeated as required.

The intermediate transfer belt 50 after secondary transfer of the full-color toner image onto the transfer sheet is cleaned by the belt cleaning device 35 to remove residual toner adhering to the intermediate transfer belt 50. Thereafter, toner images for the next sequence of image forming operations are transferred onto the intermediate transfer belt 50 from the photoconductors 1 to form a full-color toner image on the intermediate transfer belt 50, and the full-color toner image thus formed is transferred onto a transfer sheet. The above-described sequence of image forming operations is repeated as required.

A process linear velocity of each of the photoconductors 1, the intermediate transfer belt 50, and the secondary transfer roller 34 is set to 280 mm/s when regular sheets are fed, and is set to 140 mm/s when heavy sheets are fed. In this specification, a "heavy sheet" means any sheet having a thickness greater than that of a regular sheet, and is not limited to sheets of any particular weight or thickness.

It is to be noted that although two different linear velocities (hereinafter also referred to as speeds of rotation or rotation speeds) are set for the photoconductors 1 according to illustrative embodiments, alternatively, three or four different linear velocities may be applicable.

A description is now given of a configuration and operations of toner removing means and lubricant applying means of a lubricant applicator 65 of the cleaning device 6 with reference to FIG. 2.

In the cleaning device 6, a pre-cleaning neutralizing lamp 60 for neutralizing the photoconductor 1, a fur brush 61 for scraping the residual toner off the surface of the photoconductor 1, and a cleaning blade 62 serving as a removing member for removing the residual toner from the photoconductor 1 are disposed, in that order, from an upstream side to a downstream side in a direction of rotation of the photoconductor 1. The cleaning device 6 further includes a flicker 63 for flicking the residual toner adhering to the fur brush 61.

The residual toner flicked from the fur brush 61 by the flicker 63 is conveyed outside the cleaning device 6 through a conveyance screw 64. The fur brush 61 is rotated in a direction indicated by an arrow A in FIG. 2 as the photoconductor 1 rotates. It is to be noted that, in FIG. 2, a state in which the fur brush 61 slightly digs into the photoconductor 1 illustrates a relative position of the fur brush 61 and the photoconductor 1 in appearance.

The cleaning blade 62 is fixed to a rotatably held holder, not shown, and is supported to contact the photoconductor 1 against the direction of rotation of the photoconductor 1. In addition, the cleaning blade 62 is pressed against the photoconductor 1 with a pressure spring, not shown, to remove the residual toner adhering to the photoconductor 1. After the toner is removed from the photoconductor 1 by the cleaning blade 62, a lubricant 67 such as zinc stearate is applied to the photoconductor 1 by a roller-type coating brush 66 serving as a lubricant applying member of the lubricant applicator 65. As can be appreciated, the lubricant 67 is applied to the photoconductor 1 in order to improve cleaning performance of the cleaning blade 62, ultimately providing higher quality images.

The lubricant 67 in solid form is held by a guide bracket, not shown, and pressed against the coating brush 66 by a spring 68, so that the coating brush 66 scrapes off the lubricant 67 to apply the lubricant 67 to the photoconductor 1. It is to be noted that, in FIG. 2, a state in which the coating brush 66 slightly digs into the photoconductor 1 illustrates a relative position of the coating brush 66 and the photoconductor 1 in appearance.

The coating brush 66 is rotatively driven by a motor, not shown, and a rotary speed (or a linear velocity) of the coating brush 66 is variable. A coating blade 69 serving as a smoothing member including a rubber blade to smooth the lubricant 67 in a form of powder applied to the photoconductor 1 by the coating brush 66 is provided on a downstream side from the lubricant applicator 65 relative to the direction of rotation of the photoconductor 1 to contact the photoconductor 1 against the direction of rotation of the photoconductor 1.

It is well known that the lower a frictional factor of the surface of the photoconductor 1, the higher the cleaning performance of the cleaning blade 62. However, the lower frictional factor of the surface of the photoconductor 1 causes an increase in an amount of the lubricant 67 in a form of powder on the surface of the photoconductor 1 passing through the cleaning blade 62. Consequently, the lubricant 67 adheres to a surface of the charger 2, causing irregular images.

To solve the above-described problems, an amount of the lubricant 67 in a range between 100 mg and 180 mg is scraped off by the coating brush 66 each time the photoconductor 1 is rotated for 1 km as a running distance.

The amount of the lubricant 67 scraped off by the coating brush 66 is controlled by a fiber structure and a speed of rotation of the coating brush 66 and a force of the spring 68.

The force of the spring 68 is set to 4N. The coating brush 66 includes a conductive polyester brush having straight fibers. The coating brush 66 has an outer diameter of 14 mm, a diameter of each fiber of 6 deniers, a density of the fibers of 50,000 fibers/inch$^2$, and a length of each fiber of 4 mm.

As described above, a linear velocity of the photoconductor 1 during feeding of the regular sheets is set to 280 mm/s. In other words, a linear velocity of the photoconductor 1 having an outer diameter of 60 mm is set to 89.17 rpm. A linear velocity of the photoconductor 1 during feeding of the heavy sheets is set to 140 mm/s. In other words, a linear velocity of the photoconductor 1 having an outer diameter of 60 mm is set to 44.58 rpm.

At this time, a speed of rotation of the coating brush 66 is set to 200 rpm during feeding of the regular sheets. Meanwhile, conventionally, a linear velocity of a widely-used coating brush of the related art during feeding of the heavy sheets has been set to 100 rpm, that is, half of the speed of rotation of the coating brush 66 during feeding of the regular sheets, using a ratio that is the same as the ratio between the linear velocities of the photoconductor 1 during feeding of the regular sheets and during feeding of the heavy sheets.

However, because a force applied to the lubricant 67 from the coating brush 66 is affected by the linear velocity of the coating brush 66, in a case in which the speed of rotation of the coating brush 66 is set with the ratio same as the ratio between the linear velocity of the photoconductor 1 during feeding of the regular sheets and that of the photoconductor 1 during feeding of the heavy sheets as described above, an amount of the lubricant 67 scraped off by the coating brush 66 differs between when the coating brush 66 is rotated at the linear velocity of 200 rpm during feeding of the regular sheets and when the coating brush 66 is rotated at the linear velocity of 100 rpm during feeding of the heavy sheets, considerably decreasing the amount of the lubricant 67 scraped off by the coating brush 66 during feeding of the heavy sheets.

Specifically, when the coating brush 66 was rotated at the linear velocity of 200 rpm during feeding of the regular sheets, the amount of the lubricant 67 scraped off by the coating brush 66 was 130 mg each time the photoconductor 1 is rotated for 1 km as a running distance. By contrast, when the coating brush 66 was rotated at the linear velocity of 100 rpm during feeding of the heavy sheets, the amount of the lubricant 67 scraped off by the coating brush 66 was 80 mg each time the photoconductor 1 is rotated for 1 km as a running distance, resulting in a shortage of the amount of the lubricant 67 applied to the surface of the photoconductor 1.

In order to prevent the shortage of the amount of the lubricant 67, according to illustrative embodiments, a linear velocity n of the coating brush 66 satisfies a relation of $n_t/N_1>n_2/N_2>\ldots n_x/N_x$, where $N_1, N_2, \ldots N_x$ ($N_1<N_2<\ldots N_x$) are multiple linear velocities of the photoconductor 1, respectively, and $n_1, n_2, \ldots n_x$ are multiple linear velocities of the coating brush 66 corresponding to the multiple linear velocities of the photoconductors 1, respectively.

Here, the speed of rotation of the coating brush 66 during feeding of the heavy sheets is set to 160 rpm.

Specifically, the linear velocity $N_1$ of the photoconductor 1 during feeding of the heavy sheets is 140 mm/s (at 44.58 rpm), which is smaller than the linear velocity $N_2$ of the photoconductor 1 during feeding of the regular sheets, that is, 280 mm/s (at 89.17 rpml), and the linear velocities $n_1$ and $n_2$ of the coating brush 66 respectively corresponding to the linear velocities $N_1$ and $N_2$ of the photoconductor 1 are set to 117.3 mm/s (at 160 rpm) and 146.6 mm/s (at 200 rpm), respectively. Accordingly, $n_1/N_1$ is about 0.84, and $n_2/N_2$ is about 0.52, thereby satisfying the above-described relation of $n_1/N_1>n_2/N_2$.

It is to be noted that, although only the two different linear velocities are set as described above according to illustrative embodiments, alternatively, three or more different linear velocities may be set. For example, when the linear velocity $N_3$ of the photoconductor 1 is 352.6 mm/s (112.24 rpm), the linear velocity $n_3$ of the coating brush 66 is set to 161.3 mm/s (220 rpm). Accordingly, $n_3/N_3$ is about 0.46, thereby satisfying the above-described relation of $n_1/N_1>n_2/N_2>\ldots n_x/N_x$.

In order to prevent the coating blade 69 from cracking at its edge and to protect the coating blade 69 from abrasion, the coating blade 69 is set to contact the photoconductor 1 at an obtuse angle greater than 90° and smaller than 140°.

According to illustrative embodiments, an angle θ of the edge of the coating blade 69 against the photoconductor 1 is set to 125° to improve rigidity of the edge of the coating blade 69.

According to illustrative embodiments, the sequence of image forming operations is started after a user sets to feed the regular sheets or the heavy sheets. Therefore, the speed of rotation of the coating brush 66 cannot be changed during the sequence of image forming operations such as latent image formation, development, primary transfer, and secondary transfer. When a type of sheets to be fed is set and the linear velocity of the photoconductor 1 is decided, control means sets the speed of rotation of the coating brush 66 that satisfies the above-described relation prestored in the image forming apparatus 100.

Figure 4:
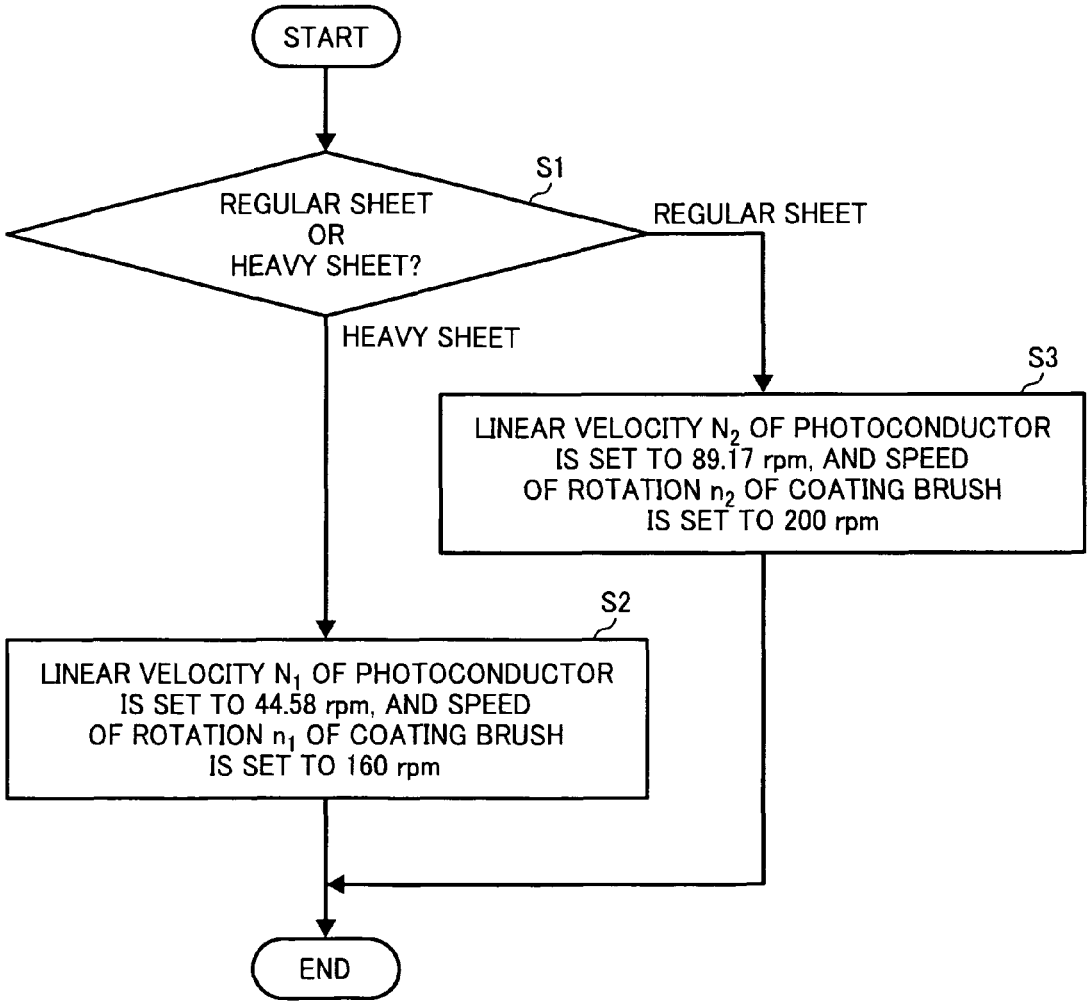
FIG. 4 is a flowchart illustrating steps in a process of setting a speed of rotation of a coating brush.

FIG. 4 is a flowchart illustrating steps in a process of setting the speed of rotation of the coating brush 66. At S1, a type of sheets to be fed is determined. When the heavy sheets are to be fed, the process proceeds to S2 so that the linear velocity $N_1$ of the photoconductor 1 is set to 44.58 rpm, and the control means sets the speed of rotation $n_1$ of the coating brush 66 to 160 rpm. By contract, when the regular sheets are to be fed, the process proceeds to S3 so that the linear velocity $N_2$ of the photoconductor 1 is set to 89.17 rpm, and the control means sets the speed of rotation $n_2$ of the coating brush 66 to 200 rpm.

Accordingly, the linear velocities of the coating brush 66 are set corresponding to the multiple linear velocities of the photoconductor 1 as described above. As a result, a constant amount of the lubricant 67 is reliably applied to the photoconductor 1 regardless of the linear velocities of the photoconductor 1.

It is to be noted that, although the case in which the linear velocity of the photoconductor 1 is changed by a type of sheets to be fed is described above, the foregoing illustrative embodiments are also applicable to a case in which the linear velocity of the photoconductor 1 is changed by factors other than the type of sheets to be fed.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A lubricant applicator rotatable at multiple different linear velocities, comprising:

a rotatable lubricant applying member to scrape a lubricant and to apply the lubricant to a surface of an image carrier rotatable at multiple different linear velocities, wherein the lubricant applicator is configured to reduce a linear velocity of the lubricant applying member in response to a reduction in the linear velocity of the image carrier, and increase the linear velocity of the image carrier, such that any given linear velocity of the lubricant applying member satisfies a relation of $n_1/N_1>n_2/N_2> \ldots n_x/N_x$, where $N_1, N_2, \ldots N_x$ ($N_1<N_2< \ldots N_x$) are the multiple different linear velocities of the image carrier, $n_1, n_2, \ldots n_x$ are multiple linear velocities of the lubricant applying member corresponding to the multiple linear velocities of the image carrier, and x is an integer that increase in value in correspondence with a relative increase in the linear velocities of the lubricant applying member and the image carrier.

2. The lubricant applicator according to claim 1, wherein the lubricant applying member comprises a brush roller having straight fibers.

3. An image forming apparatus, comprising:

an image carrier, rotated to carry an electrostatic latent image on a surface thereof;

a transfer member to transfer the toner image onto a recording medium; and a lubricant applicator rotatable at multiple different linear velocities, comprising a rotatable lubricant applying member to scrape a lubricant and to apply the lubricant to the surface of the image carrier rotatable at multiple different linear velocities, wherein the image forming apparatus is configured to reduce the linear velocity of the lubricant applying member in response to a reduction in a linear velocity of the image carrier, and increase the linear velocity of the lubricant applying member in response to an increase in the linear velocity of the image carrier, such that any given linear velocity of the lubricant applying member satisfies a relation of $n_1/N_1>n_2/N_2> \ldots n_x/N_x$, where $N_1, N_2, \ldots N_x$ ($N_1<N_2< \ldots N_x$) are the multiple different linear velocities of the image carrier, and $n_1, n_2, \ldots n_x$ are multiple linear velocities of the lubricant applying member corresponding to the multiple linear velocities of the image carrier, and x is an integer that increases in value in correspondence with a relative increase in the linear velocities of the lubricant applying member and the image carrier.

4. The image forming apparatus according to claim 3, wherein the linear velocity of the lubricant applying member is changed at a timing other than electrostatic latent image formation on the surface of the image carrier, toner image formation, transfer of the toner image onto the transfer member from the image carrier, transfer of the toner image onto the recording medium from the image carrier, and transfer of the toner image onto the recording medium from the transfer member.

5. The image forming apparatus according to claim 3, further comprising a smoothing member, the smoothing member comprising a rubber blade provided on a downstream side from the lubricant applicator relative to a direction of rotation of the image carrier to contact the image carrier, wherein an angle formed by an edge of the smoothing member contacting the image carrier is an obtuse angle greater than 90° and smaller than 140°.

6. The image foaming apparatus according to claim 3, further comprising a removing member to remove residual toner adhering to the image carrier, wherein the lubricant applicator is provided on a downstream side from the removing member relative to the direction of rotation of the image carrier.

7. A process cartridge detachably attachable to an image forming apparatus, the image forming apparatus comprising:

an image carrier, rotated to carry an electrostatic latent image on a surface thereof;

a transfer member to transfer the toner image onto a recording medium; and a lubricant applicator rotatable at multiple different linear velocities, comprising a rotatable lubricant applying member to scrape a lubricant and to apply the lubricant to the surface of the image carrier rotatable at multiple different linear velocities, wherein:

the image carrier and the lubricant applicator are integrally provided in the process cartridge; and wherein the image forming apparatus is configured to reduce the linear velocity of the lubricant applying member in response to a reduction in a linear velocity of the image carrier, and increase the linear velocity of the lubricant applying member in response to an increase in the linear velocity of the image carrier, such that any given linear velocity of the lubricant applying member satisfies a relation of $n_1/N_1>n_2/N_2> \ldots n_x/N_x$, where $N_1, N_2, \ldots N_x$ ($N_1<N_2< \ldots N_x$) are the multiple different linear velocities of the image carrier, and $n_1, n_2, \ldots n_x$ are multiple linear velocities of the lubricant applying member corresponding to the multiple linear velocities of the image carrier, and x is an integer that increase in value in correspondence with a relative increase in the linear velocities of the lubricant applying member and the image carrier.

* * * * *